US008907187B2

(12) United States Patent
Woods

(10) Patent No.: US 8,907,187 B2
(45) Date of Patent: Dec. 9, 2014

(54) STRINGED MUSICAL INSTRUMENT WITH A GUITAR-BANJO COMBINATION SOUND

(71) Applicant: Christopher B Woods, Simpsonville, SC (US)

(72) Inventor: Christopher B Woods, Simpsonville, SC (US)

( * ) Notice: Subject to any disclaimer, the term of this patent is extended or adjusted under 35 U.S.C. 154(b) by 0 days.

(21) Appl. No.: 14/073,673

(22) Filed: Nov. 6, 2013

(65) Prior Publication Data

US 2014/0123829 A1 May 8, 2014

Related U.S. Application Data

(60) Provisional application No. 61/723,239, filed on Nov. 6, 2012.

(51) Int. Cl.

| | |
|---|---|
| ***G10D 1/00*** | (2006.01) |
| ***G10D 1/08*** | (2006.01) |
| ***G10D 1/10*** | (2006.01) |
| ***G10D 3/02*** | (2006.01) |

(52) U.S. Cl.
CPC .. *G10D 1/08* (2013.01); *G10D 1/10* (2013.01); *G10D 3/02* (2013.01)
USPC ..... 84/263; 84/291

(58) Field of Classification Search
CPC ..... G10D 1/08; G10D 1/10; G10D 3/02
See application file for complete search history.

(56) References Cited

U.S. PATENT DOCUMENTS

| | | | | | |
|---|---|---|---|---|---|
| 554,967 | A * | 2/1896 | Wilkes | 84/271 |
| 555,636 | A * | 3/1896 | Carter | 84/271 |
| 604,630 | A * | 5/1898 | McLean | 84/270 |
| 1,069,987 | A * | 8/1913 | Taylor et al. | 84/269 |
| 1,185,980 | A * | 6/1916 | Campanella | 84/271 |
| 1,355,977 | A * | 10/1920 | Irwin et al. | 84/296 |
| 1,607,449 | A * | 11/1926 | Edwards | 84/263 |
| 1,634,730 | A * | 7/1927 | Travaglini | 84/263 |
| 1,642,126 | A * | 9/1927 | Norwood | 84/269 |
| 2,023,358 | A * | 12/1935 | Porter | 84/269 |
| 3,233,495 | A * | 2/1966 | Bernardi | 84/294 |
| 3,457,820 | A * | 7/1969 | Snider | 84/296 |
| 3,633,452 | A * | 1/1972 | Beasley | 84/263 |
| 3,956,963 | A * | 5/1976 | Milton | 84/296 |
| 4,738,178 | A * | 4/1988 | Deering | 84/726 |
| 6,191,346 | B1 * | 2/2001 | Swan | 84/307 |
| 8,278,538 | B1 * | 10/2012 | D'Anda et al. | 84/294 |
| 2014/0123829 | A1 * | 5/2014 | Woods | 84/263 |

* cited by examiner

*Primary Examiner* — Robert W Horn

(57) ABSTRACT

A stringed musical instrument with a guitar-banjo combination sound is an apparatus that is designed to be played in the same manner as a typical guitar but is also designed to be more portable than a typical guitar. The apparatus includes a sound box coupled to a guitar neck, which allows a plurality of strings to tensioned and connected along the apparatus. The sound box is configured to produce the guitar-banjo combination sound. The sound box includes a stretched membrane, a pot chamber, a channel, and a sound chamber. The stretched membrane is perimetrically connected around the pot chamber and is used to create the banjo portion of the apparatus's sound. stretched membrane resonates the air within the pot chamber, whose sound waves travel through the channel in order to be modified by the sound chamber. A bridge is used to connect the plurality of strings to the stretched membrane.

15 Claims, 5 Drawing Sheets

STRINGED MUSICAL INSTRUMENT WITH A GUITAR-BANJO COMBINATION SOUND

The current application claims a priority to the U.S. Provisional Patent application Ser. No. 61/723,239 filed on Nov. 6, 2012.

FIELD OF THE INVENTION

The present invention relates generally to an apparatus for a kind of stringed instrument. More specifically, the present invention is a small portable guitar that sounds similar to a banjo.

BACKGROUND OF THE INVENTION

The present invention is for guitar players who want to produce a banjo sound without having to use a cumbersome, heavy banjo or banjitar. Relevant prior arts include U.S. Pat. No. 3,633,452. Although others have invented combined guitar and banjo instruments, the present invention is superior because of the following advantages: it is not cumbersome; it is not expensive to build; it is not complicated to use; it does not need a banjo shell, head, or securing ring; the resonator is preferably aluminum; it is light weight; and it is comfortable to play for long periods of time. Therefore, the objective of the present invention is to provide on a combined guitar and banjo instrument that allows a user with the aforementioned features.

A user will play this small guitar with banjo sound in the same way as he/she would a standard guitar using the same tunings, chords, and scales as a standard guitar. While playing the present invention, he/she would produce a sound that is similar to a banjo. The user could also use different types of strums, such as raking the strings, using arpeggios, and playing with a pick or picks in order to make the present invention sound even more like a banjo. Again, the user would also find the present invention to be easier to play, to be more light weight, and to be more comfortable than a heavy, bulky, banjo or banjitar.

DETAILED DESCRIPTIONS OF THE INVENTION

All illustrations of the drawings are for the purpose of describing selected versions of the present invention and are not intended to limit the scope of the present invention.

Figure 2:
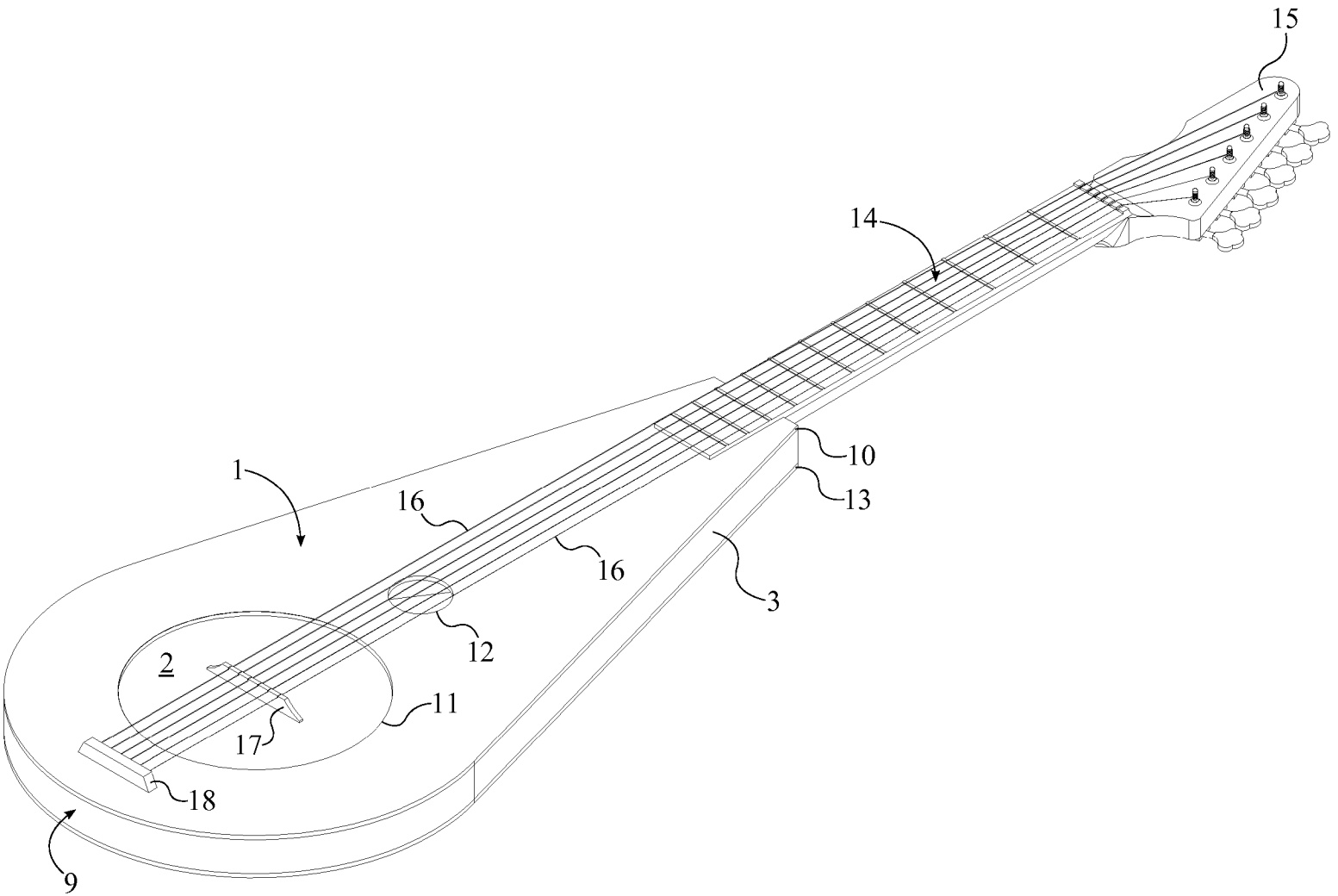
FIG. 2 is a perspective view of the present invention.
Figure 3:
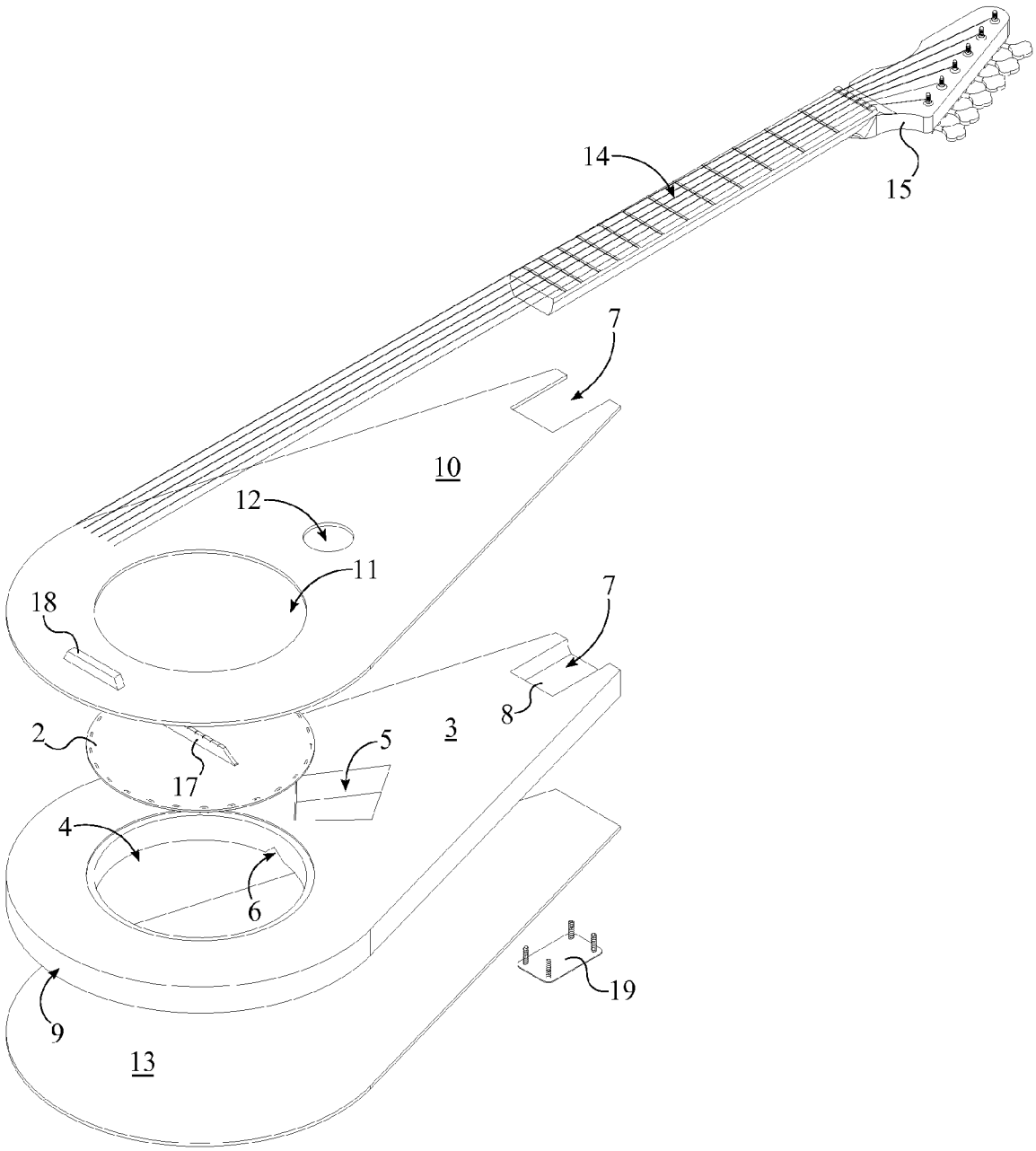
FIG. 3 is a top-right exploded view of the present invention.

As can be seen FIGS. 2 and 3, the present invention is a stringed musical instrument that is capable of producing a guitar-banjo combination sound. The present invention is designed to be relatively smaller than a typical guitar or banjo, which allows the present invention to be more portable than a typical guitar. The present invention also allows a guitar player to use the same tuning and chords as a typical guitar but additionally utilizes a stretched membrane to produce a banjo sound. The present invention mainly comprises a sound box 1, a guitar neck 14, a plurality of strings 16, a bridge 17, a tailpiece 18, and a fastening plate 19. The plurality of strings

16 is tensioned across the present invention, and an individual string or a combination of strings can be plucked or strummed in order to produce different musical notes and chords with the present invention. The sound box 1 is used to modify the sound produced by the plurality of strings 16 and is used to transfer that sound to the surrounding air. The bridge 17 is the means of transferring the vibrations from the plurality of strings 16 to the sound box 1. The guitar neck 14 and the tailpiece 18 are used to tension the plurality of strings 16 to the proper length across the present invention. The guitar neck 14 is also partitioned by frets in order to indicate which musical notes can be played by the plurality of strings 16. In the preferred embodiment of the present invention, the guitar neck 14 is a small twelve-fret neck resembling an electric guitar. In an alternative embodiment, a banjo neck could be used instead of the guitar neck 14.

Figure 4:
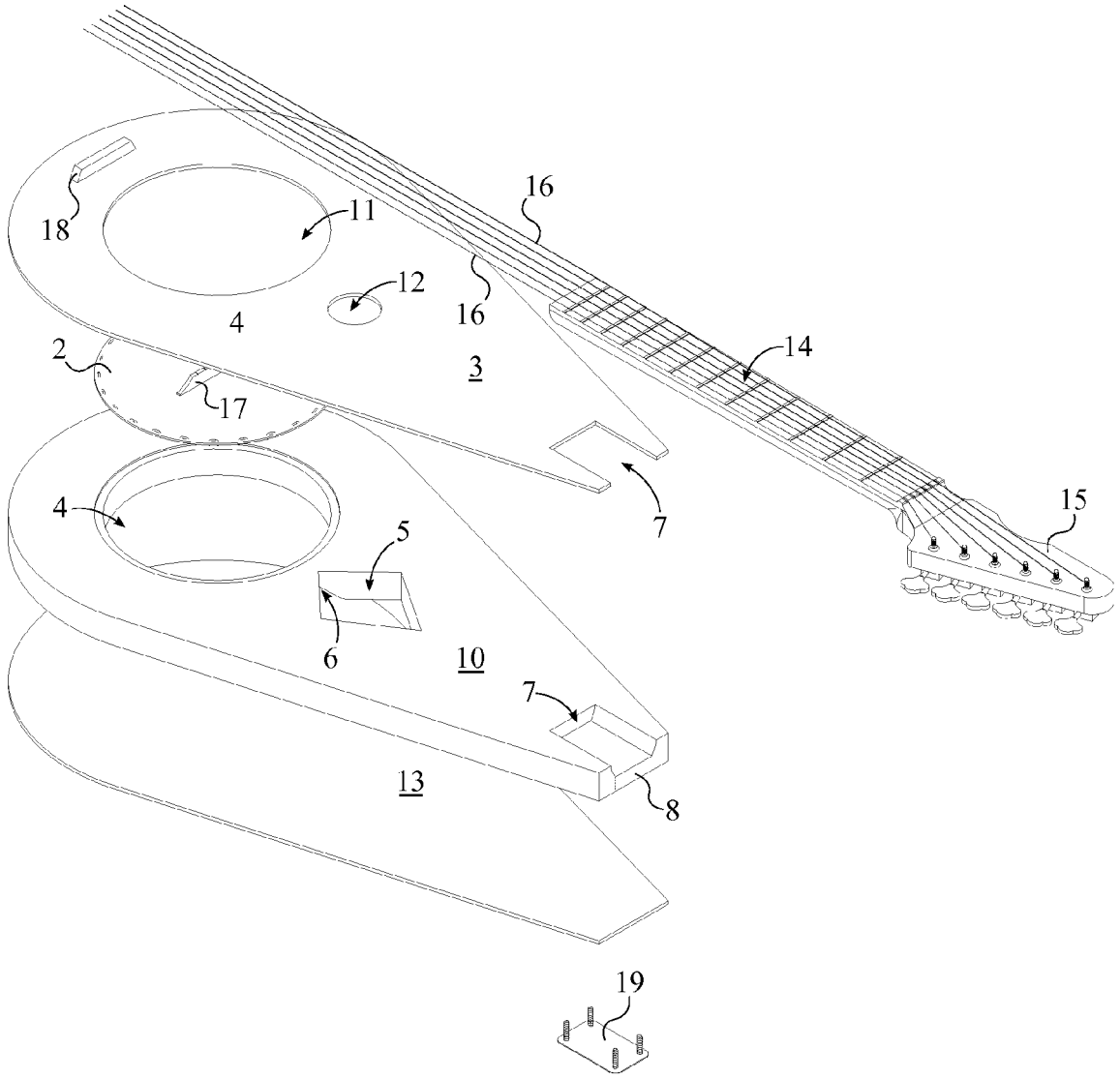
FIG. 4 is a top-left exploded view of the present invention.

The configuration of the sound box 1 is the means of producing the guitar-banjo combination sound with the present invention. The sound box 1 comprises a stretched membrane 2, an inner body 3, a neck slot 7, a neck raiser 8, a butt 9, a top skin 10, and a bottom skin 13, which are shown in FIGS. 3 and 4. The inner body 3 is the structural base of the sound box 1 and is used to position the other components of the sound box 1. The inner body 3 is sandwiched in between the top skin 10 and the bottom skin 13, which are used as an outer covering in order to protect the internal components of the sound box 1. The top skin 10 is affixed across the inner body 3, and the bottom skin 13 is affixed to the inner body 3. In the preferred embodiment of the present invention, the top skin 10 or the bottom skin 13 is affixed to the inner body 3 via glue under high pressure. Also in the preferred embodiment, the lateral side of the sound box 1 is covered with a wood-filler paste, which hides the sandwich appearance of the top skin 10, the inner body 3, and the bottom skin 13. Also in the preferred embodiment, the top skin 10, the inner body 3, and the bottom skin 13 have a light-bulb shape. In an alternative embodiment, the top skin 10, the inner body 3, and the bottom skin 13 can be shaped to accommodate a knee rest.

Figure 1:
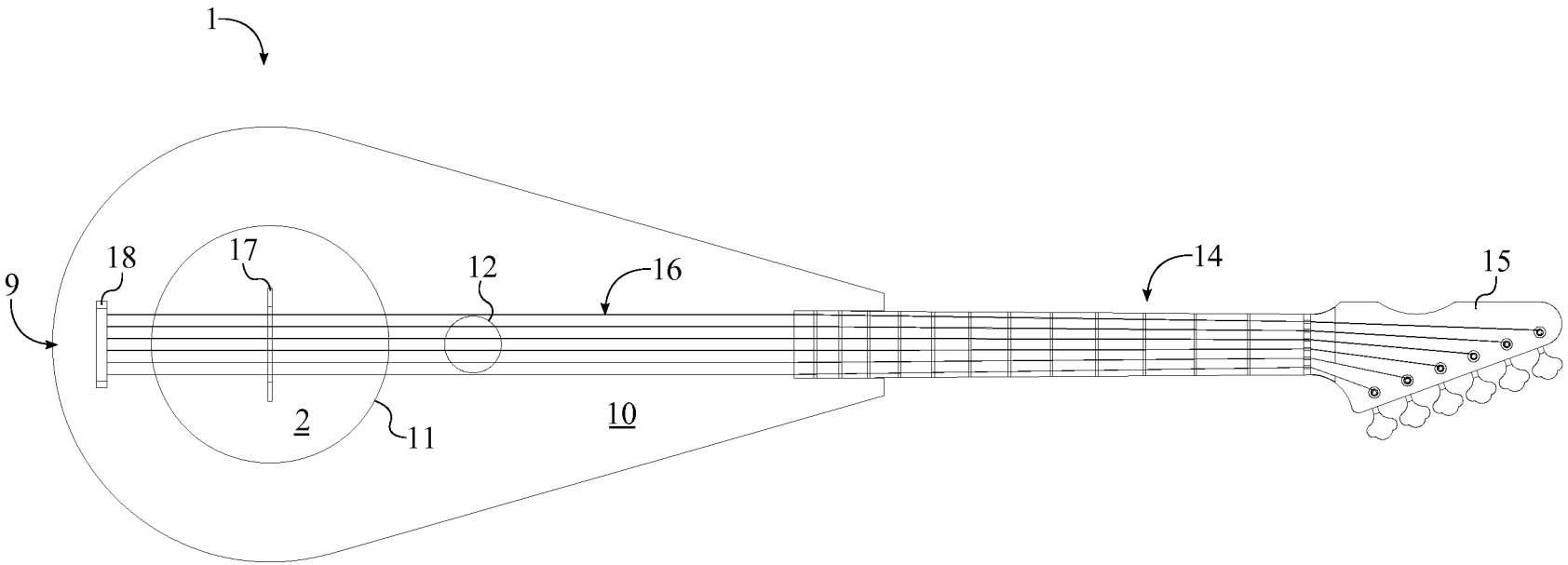
FIG. 1 is a top view of the present invention.
Figure 5:
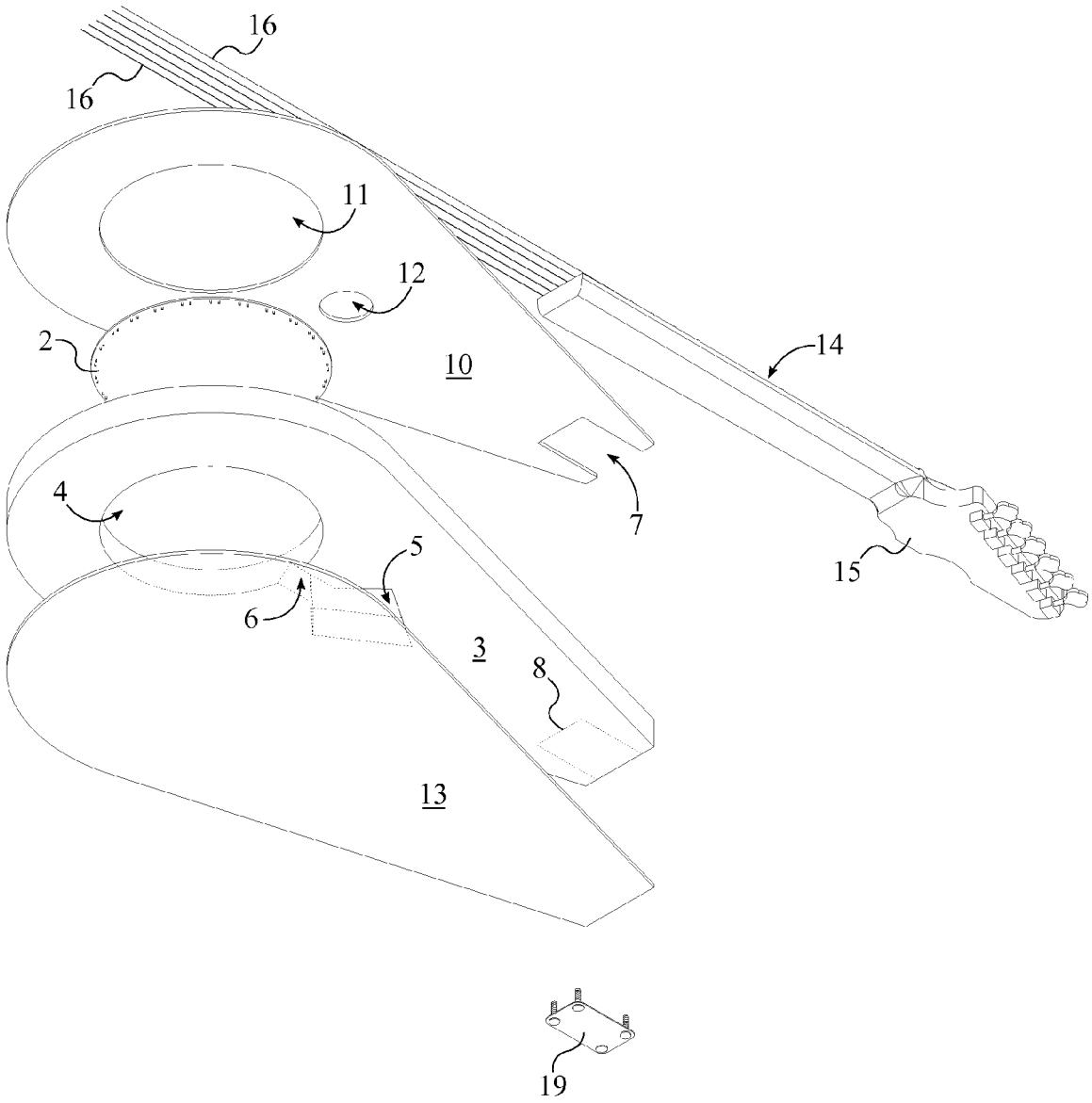
FIG. 5 is a bottom-right exploded view of the present invention.

Moreover, the neck slot 7 and the butt 9 are positioned opposite to each other along the sound box 1, which is illustrated in FIGS. 1 and 5. The neck slot 7 allows the guitar neck 14 to properly position and couple with the sound box 1, and the butt 9 is the other end of the sound box 1, which usually is the heavier and larger end of a stringed instrument. The neck slot 7 is a space that traverses into both the top skin 10 and the inner body 3 so that the guitar neck 14 protrudes out from the top skin 10 and, thus, is easier for a user to fret musical notes with the guitar neck 14. The neck raiser 8 is also positioned into the inner body 3 adjacent to the neck slot 7 so that the neck raiser 8 is able to support the guitar neck 14 in terms of stability, height, and neck angle. The neck raiser 8 can either be a separate physical component from the inner body 3 or be integrated into the inner body 3. In order to couple the guitar neck 14 with the sound box 1, the guitar neck 14 is positioned onto the neck raiser 8 and is mounted within the neck slot 7 by the fastening plate 19. More specifically, the fastening plate 19 is connected to the guitar neck 14 through both the bottom skin 13 and the neck raiser 8.

As can be seen in FIG. 2, the following components of the sound box 1 are actually responsible for the present invention's unique sound. The stretched membrane 2 allows the sound box 1 to directly receive vibrations from the plurality of strings 16 as the user plucks or strums the plurality of strings 16. The stretched membrane 2 is also perimetrically connected onto the inner body 3 around the pot chamber 4, which allows the stretched membrane 2 to resonate the air confined within the boundaries of the pot chamber 4. In the preferred embodiment of the present invention, the stretched membrane 4 is made of aluminum and is attached to the inner body 3 by a plurality of staples. The pot chamber 4 is a cavity that traverses through the inner body 3 and is located adjacent to the butt 9. The stretched membrane 2 and the pot chamber 4 produce the banjo portion of the present invention's unique sound. The sound chamber 5 is also a cavity that traverses through the inner body 3 but is located in between the pot chamber 4 and the neck slot 7. The sound chamber 5 is shaped to modify the pressure waves generated by the resonating air within the pot chamber 4. The channel 6 allows these pressure waves to travel from the pot chamber 4 to the sound chamber 5 without having to travel through the solid sections of the inner body 3. Thus, the channel 6 traverses through the inner body 3 from the pot chamber 4 to the sound chamber 5. Also in the preferred embodiment, the channel 6 is a 45 degree cut into the inner body 3.

The top skin 10 must allow the plurality of strings 16 to transfer vibrations to the stretched membrane 2 and allow the sound box 1 to release the present invention's unique sound. Thus, the top skin 10 comprises a resonator hole 11 and a sound hole 12, which are shown in FIGS. 3, 4, and 5. The resonator hole 11 is positioned onto the stretched membrane 2 so that the top skin 10 does not cover the stretched membrane 2. Consequently, the bridge 17 can be connected normal to the stretched membrane 2 through the resonator hole 11, which allows vibrations to travel from the plurality of strings 16, through the bridge 17, and onto the stretched membrane 2. The sound hole 12 is positioned onto the sound chamber 5 so that the modified sound created by the sound chamber 5 can travel out of the present invention without having to travel through the top skin 10. In addition, the tailpiece 18 is used to anchor one end of the plurality of strings 16 and, thus, is connected normal to the top skin 10 in between the butt 9 and the resonator hole 11. In the preferred embodiment of the present invention, the inner body 3, the top skin 10, the bottom skin 13, the guitar neck 14, the bridge 17, and the tailpiece 18 are made of wood.

As can be seen in FIG. 1, the plurality of strings 16 is tensioned across the two ends of the present invention so that the plurality of strings 16 can be plucked or strummed like a typical guitar-type instrument. The guitar neck 14 comprises a headstock 15, which allows the user to precisely tension and tune each of the plurality of strings 16. The headstock 15 and the sound box 1 are positioned opposite to each other along the guitar neck 14. Consequently, the plurality of strings 16 is positioned over and along the guitar neck 14 so that the user can fret the plurality of strings 16 along the guitar neck 14. More specifically, the plurality of strings 16 is operatively connected and the tensioned from the tailpiece 18 to the headstock 15, which allows the plurality of strings 16 to be braced by the bridge 17. The bridge 17 further tensions the plurality of strings 16 by directly contacting the plurality of strings 16. As a result, vibrations generated by plucking or strumming the plurality of strings 16 are easily transferred to the stretched membrane 2 through the bridge 17. In an alternative embodiment of the present invention, pickups could be added onto the sound box 1 in order to amplify the sound of the present invention.

Although the invention has been explained in relation to its preferred embodiment, it is to be understood that many other possible modifications and variations can be made without departing from the spirit and scope of the invention as hereinafter claimed.

What is claimed is:

1. A stringed musical instrument with a guitar-banjo combination sound comprises:

a sound box;

a guitar neck;

a plurality of strings;

a bridge;

a tailpiece;

a fastening plate;

said sound box comprises a stretched membrane, an inner body, a neck slot, a neck raiser, a butt, a top skin, and a bottom skin;

said inner body comprises a solid material with hollow portions comprising a pot chamber, a sound chamber, and a channel; and said top skin comprises a resonator hole and a sound hole.

2. The stringed musical instrument with a guitar-banjo combination sound as claimed in claim 1 comprises:

said inner body being sandwiched between said top skin and said bottom skin;

said top skin being affixed across said inner body; and said bottom skin being affixed across said inner body.

3. The stringed musical instrument with a guitar-banjo combination sound as claimed in claim 1 comprises:

said neck slot and said butt being positioned opposite to each other along said sound box;

said neck slot traversing into both said top skin and said inner body; and said neck raiser being positioned into said inner body adjacent to said neck slot.

4. The stringed musical instrument with a guitar-banjo combination sound as claimed in claim 3 comprises:

said guitar neck being positioned onto said neck raiser;

said guitar neck being mounted within said neck slot by said fastening plate; and said fastening plate being connected to said guitar neck through both said bottom skin and said neck raiser.

5. The stringed musical instrument with a guitar-banjo combination sound as claimed in claim 1 comprises:

said stretched membrane being perimetrically connected onto said inner body around said pot chamber;

said pot chamber traversing through said inner body adjacent to said butt;

said sound chamber traversing through said inner body in between said pot chamber and said neck slot; and said channel traversing through said inner body from said pot chamber to said sound chamber.

6. The stringed musical instrument with a guitar-banjo combination sound as claimed in claim 1 comprises:

said resonator hole being positioned onto said stretched membrane;

said bridge being connected normal to said stretched membrane through resonator hole;

said sound hole being positioned adjacent to said sound chamber; and said tailpiece being connected normal to said top skin in between said butt and said resonator hole.

7. The stringed musical instrument with a guitar-banjo combination sound as claimed in claim 1 comprises:

said guitar neck comprises a head stock;

said head stock and said sound box being positioned opposite to each other along said guitar neck;

said plurality of strings being operatively connected and tensioned from said tailpiece to said head stock; and said plurality of strings being braced by said bridge.

8. A stringed musical instrument with a guitar-banjo combination sound comprises: a sound box; a guitar neck; a plurality of strings; a bridge; a tailpiece; a fastening plate;

said sound box comprises a stretched membrane, an inner body, a neck slot, a neck raiser, a butt, a top skin, and a bottom skin;

said inner body comprises a solid material with hollow portions comprising a pot chamber, a sound chamber, and a channel; said top skin comprises a resonator hole and a sound hole;

said stretched membrane being perimetrically connected onto said inner body around said pot chamber;

said pot chamber traversing through said inner body adjacent to said butt;

said sound chamber traversing through said inner body in between said pot chamber and said neck slot; and said channel traversing through said inner body from said pot chamber to said sound chamber.

9. The stringed musical instrument with a guitar-banjo combination sound as claimed in claim 8 comprises:

said inner body being sandwiched between said top skin and said bottom skin;

said top skin being affixed across said inner body;

said bottom skin being affixed across said inner body;

said guitar neck comprises a head stock;

said head stock and said sound box being positioned opposite to each other along said guitar neck;

said plurality of strings being operatively connected and tensioned from said tailpiece to said head stock; and said plurality of strings being braced by said bridge.

10. The stringed musical instrument with a guitar-banjo combination sound as claimed in claim 8 comprises:

said neck slot and said butt being positioned opposite to each other along said sound box;

said neck slot traversing into both said top skin and said inner body;

said neck raiser being positioned into said inner body adjacent to said neck slot;

said guitar neck being positioned onto said neck raiser;

said guitar neck being mounted within said neck slot by said fastening plate; and said fastening plate being connected to said guitar neck through both said bottom skin and said neck raiser.

11. The stringed musical instrument with a guitar-banjo combination sound as claimed in claim 8 comprises:

said guitar neck comprises a head stock;

said head stock and said sound box being positioned opposite to each other along said guitar neck;

said plurality of strings being operatively connected and tensioned from said tailpiece to said head stock; and said plurality of strings being braced by said bridge.

12. A stringed musical instrument with a guitar-banjo combination sound comprises:

a sound box;

a guitar neck;

a plurality of strings; a bridge; a tailpiece; a fastening plate;

said sound box comprises a stretched membrane, an inner body, a neck slot, a neck raiser, a butt, a top skin, and a bottom skin;

said inner body comprises a solid material with hollow portions comprising a pot chamber, a sound chamber, and a channel; said top skin comprises a resonator hole and a sound hole;

said stretched membrane being perimetrically connected onto said inner body around said pot chamber;

said pot chamber traversing through said inner body adjacent to said butt;

said sound chamber traversing through said inner body in between said pot chamber and said neck slot;

said channel traversing through said inner body from said pot chamber to said sound chamber;

said resonator hole being positioned onto said stretched membrane;

said bridge being connected normal to said stretched membrane through resonator hole;

said sound hole being positioned adjacent to said sound chamber; and said tailpiece being connected normal to said top skin in between said butt and said resonator hole.

13. The stringed musical instrument with a guitar-banjo combination sound as claimed in claim 12 comprises:

said inner body being sandwiched between said top skin and said bottom skin;

said top skin being affixed across said inner body;

said bottom skin being affixed across said inner body;

said neck slot and said butt being positioned opposite to each other along said sound box;

said neck slot traversing into both said top skin and said inner body; and said neck raiser being positioned into said inner body adjacent to said neck slot.

14. The stringed musical instrument with a guitar-banjo combination sound as claimed in claim 13 comprises:

said guitar neck being positioned onto said neck raiser;

said guitar neck being mounted within said neck slot by said fastening plate; and said fastening plate being connected to said guitar neck through both said bottom skin and said neck raiser.

15. The stringed musical instrument with a guitar-banjo combination sound as claimed in claim 12 comprises:

said guitar neck comprises a head stock;

said head stock and said sound box being positioned opposite to each other along said guitar neck;

said plurality of strings being operatively connected and tensioned from said tailpiece to said head stock; and said plurality of strings being braced by said bridge.

* * * * *